United States Patent [19]

Vitelli

[11] Patent Number: 4,967,968

[45] Date of Patent: Nov. 6, 1990

[54] MACHINE APT FOR THE DISPERSION, MIXING AND GRINDING OF MORE THAN ONE SUBSTANCE AT THE SAME TIME FOR THE PURPOSE OF OBTAINING HOMOGENEOUS MIXTURES OF A FIXED GRAIN, SUCH AS PAINT

[76] Inventor: Renato Vitelli, Via Darwin, 351, Rome, Italy

[21] Appl. No.: 294,575

[22] Filed: Jan. 6, 1989

[51] Int. Cl.[5] ..... B02C 17/02

[52] U.S. Cl. ..... 241/46.17; 241/74; 241/172; 366/279

[58] Field of Search ..... 366/279, 605; 241/172, 241/171, 170, 176, 73, 74, 46.17, 46.11

[56] References Cited

U.S. PATENT DOCUMENTS

| | | | |
|---|---|---|---|
| 2,212,641 | 8/1940 | Hucks | 241/172 |
| 2,681,210 | 6/1954 | Schaefer | 241/176 |
| 2,890,028 | 6/1959 | Lauffer | 366/605 X |

FOREIGN PATENT DOCUMENTS

| | | | |
|---|---|---|---|
| 78630 | 5/1985 | Japan | 366/279 |
| 489171 | 7/1938 | United Kingdom | 241/172 |

*Primary Examiner*—Mark Rosenbaum

*Attorney, Agent, or Firm*—Silverman, Cass & Singer, Ltd.

[57] ABSTRACT

A machine comprising a cylinder, a mixer and a plurality of glass balls, the cylinder including perforated walls having an upper part modelled to accept a shaft and fastened on the bottom end to the shaft which conveys the movement originated by an engine to the cylinder. Inside the cylinder, the mixer is integral with another shaft which is co-axial with the first shaft, the mixer being stationary with respect to the cylinder or driven by a separate engine which may rotate in the same direction or in the opposite direction with respect to the movement of the cylinder shaft.

4 Claims, 1 Drawing Sheet

MACHINE APT FOR THE DISPERSION, MIXING AND GRINDING OF MORE THAN ONE SUBSTANCE AT THE SAME TIME FOR THE PURPOSE OF OBTAINING HOMOGENEOUS MIXTURES OF A FIXED GRAIN, SUCH AS PAINT

SUMMARY

The machine comprises a cylinder 2, a mixer 7 and some glass balls, the cylinder, enclosed by perforated walls and having the upper part modelled so as to be able to hold 1, is fastened on the bottom end to shaft 4, which conveys the movement originated by engine 5. Inside the cylinder, besides the balls, there is a mixer 7 integral with a shaft 8 which is co-axial with shaft 4, and it is stationary or turns driven by a separate engine which may rotate in the same direction or in the opposite direction with respect to the movement of the cylinder shaft.

It is well known that, in the industrial production of many products, especially chemical ones, it becomes necessary to produce homogeneous masses starting from components of a different nature. Paint, for example, is predominantly made of a mixture of certain components which, put together in fixed quantities, are then dispersed, mixed and amalgamated together until the desired results are achieved.

A previous patent of the same holder describes and illustrates a machine which gives the possibility to avoid the aforementioned inconveniences, allowing the processing of the various materials making up the end product from the moment the materials are put into the same container up to the end product itself. This machine, even though it was a great progress compared with the methods of production in use up to then, presents the inconvenience of having to be built with enormously great precision and of requiring very accurate maintenance; these inconveniences, of course, do not make it very competitive both in the production and sale of the machine itself and of the end product.

Object of the present invention is a machine apt for the dispersion, mixing and grinding of more than one substance at the same time for the purpose of obtaining homogenous mixtures of a fixed grain, such as paint, for example, which resolves the inconveniences of the previous machine allowing the production of high quality products with extremely simplified working phases.

The principle on which this machine is based is that the components of the paint, i.e. the film-forming substances, the pigments, the diluents, the plastifying substances, the desiccators and other possible and diverse substances necessary for the production of the end product, are all put, in the required quantities, into the container and shaken inside the perforated cylinder, inside which is a mixer and numerous glass balls or similar objects in glass or other suitable materials.

The mixing element may have the most diverse shapes such as, for example, a plate shape, a shape made of one or more elongated elements, placed cross-wise or otherwise, or of any other shape deemed suitable to carry out a mixing function inside the cylinder; it is clear that the material used for the mixing element may also vary according to requirements and the materials treated.

The cylinder is driven by an engine which is preferably placed at the top end of the shaft connecting these two elements, whilst the mixing element inside the container is supported by a shaft which is co-axial with the drive shaft and which, during the normal working activity of the machine, stays still.

When the cylinder is put into rotation the relative movement between cylinder and mixing element determines a whirling motion of the balls or similar objects contained within the cylinder thus causing the dispersion, grinding and mixing of the components inside it. As previously mentioned, infact, the cylinder is almost completely perforated, the rotation thus determining, on one side a depression which drives the components towards the interior of the cylinder and on the other side a pressure which causes an outflow from the cylinder of the components, allowing a perfect dispersion, grinding and mixing of all the components contained within the cylinder.

According to a possible variant, and in the case of particular types of paint, it is possible to provide the machine with a second engine for the mixing element so as to vary the relative speed between the mixing element (disk) and the cylinder, increasing or decreasing it according to the directions of rotation of the two elements, whether they are concordant or opposite.

What has been only summarily said up to now may be better understood from the following detailed description with reference to the attached illustrations, solely as a non limitative example, in which.

Figure 1:
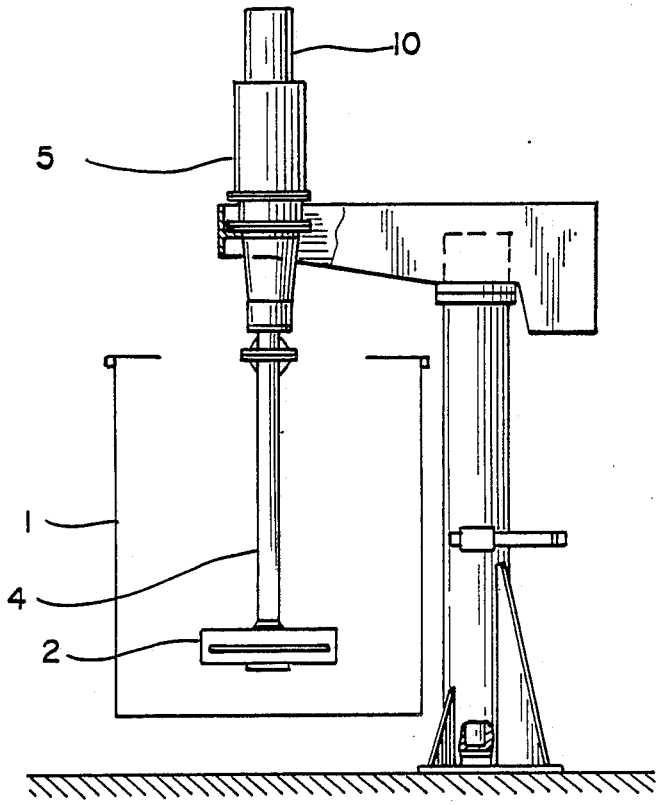
FIG. 1 shows an outline view in section of the machine.
Figure 2:
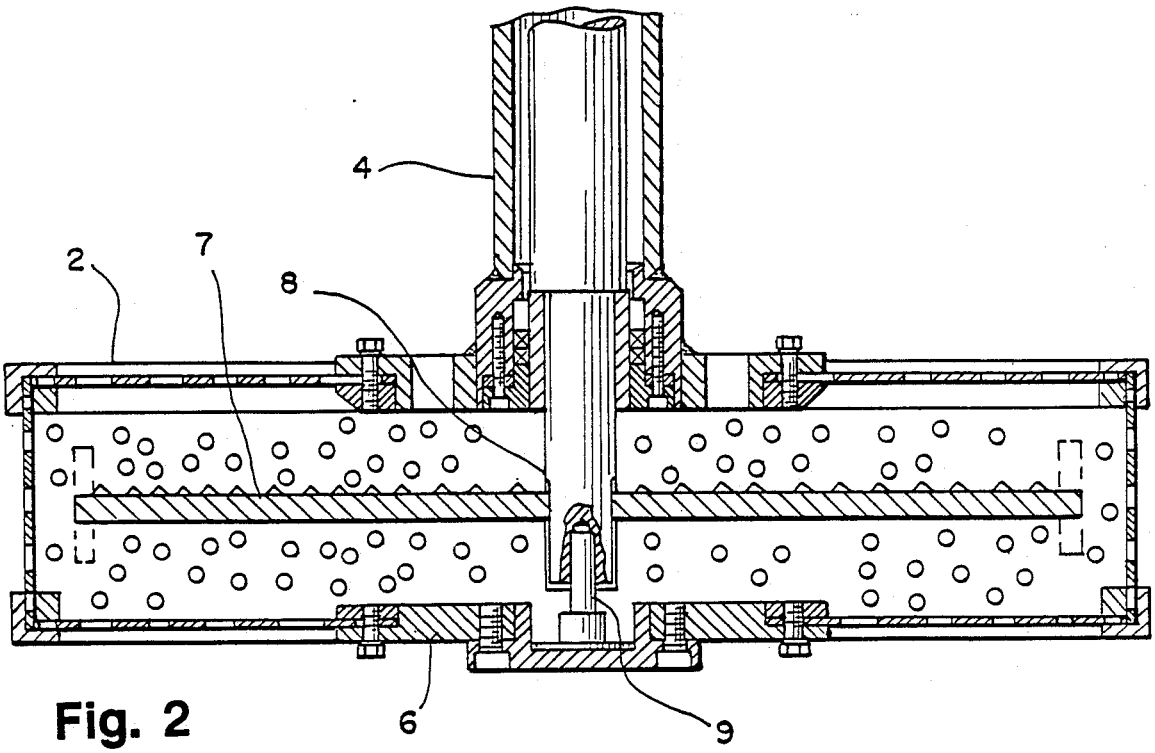
FIG. 2 shows a section view of the mixer and of the end parts of the shaft.

With reference to said figures, the machine apt for the dispersion, grinding and mixing of more than one substance at the same time for the purpose of obtaining homogenous mixture of a fixed grain, such as pain, for example, presents a cylinder 2, preferably made of metal or other suitable material able to resist the action of the paint components, the said cylinder 2 being, preferably, cylindrical in shape and enclosed on all sides with metal (or other suitable material) perforated walls. The top part 3 of the cylinder is modelled so as to hold the bottom end of the shaft 4 and to be fastened to it, by means of screws, so that the movement communicated by the engine 5 to the drive shaft 4 may then be conveyed to the cylinder 2; a further element of constraint and support for the cylinder 2 relatively to drive shaft 4 is the bottom part 6 of the same cylinder 2, which guarantees that the movement communicated to shaft 4 by the engine is uniformly distributed avoiding any anomalous torsional strain on cylinder 2. Furthermore, there are ball-bearings or other means apt to lessen friction thus favouring the cylinder's rotation.

Inside cylinder 2 there is a mixing element 7 integral with shaft 8 which is co-axial with shaft 4 but still, or in a positive variant moved by the other engine 10; the bottom end of shaft 8 is hollow so that it may house the pivot 9 on the bottom end 6 of container 2 leaving said container free to rotate without involving the mixing element 7 in its movement.

Inside cylinder 2 there are numerous glass-balls which are set into motion both my the rotation of cylinder 2 and of the mixing element 7, which gives a contribution to the activity of dispersion, grinding and mixing of the paint's components when the cylinder is lowered into the container 1 into which the components have been previously put.

The dispersion, grinding and mixing of all the paint's components are a funtion of various factors such as: the rotation of the perforated cylinder 2 which, when it is immersed inside container 1 determines, with its rotatory movement, on one side of cylinder 2 a depression which sucks the paint inside the cylinder itself and, on the other side, a pressure which throws it back into the container causing whirls which set into motion all the contents of container 1; the mixing element 7, which being still, determines a further mixing of the liquid inside the cylinder 2; and the glass balls, which are present in large quantities inside the cylinder, and which are set into motion by the rotation of the cylinder 2 and striking against the mixing element 7 and against themselves are subject to continuous changes of direction so as to determine a perfect grinding and mixing of the components.

For the purpose of optimizing the machine's working, the heat produced during operations is dispersed preferably by cooling container 1 with a known means.

It is clear that, leaving the operating principles previously listed untouched, both cylinder 2 and mixing element 7 may have a different shape: the plate, for example, as a possible variant, could have two suitably sized terminal edges.

As previously mentioned, the present machine may be provided with a second engine 10 which, alternatively to all that has been already said, communicates a rotatory movement also to the mixing element 7 for the purpose of varying, according to working needs and for special preparations, the relative speed between the cylinder 2 and the mixing element 7, said rotatory movement may be communicated both in the same direction and in the opposite direction of that of the cylinder.

The cylinder, by means of an electric hydraulic or similar control is immersed inside the container 1 or is pulled out according to need allowing a complete and simple accessibility to the container.

A further positive characteristic of the present machine is that its cleaning, necessary, for example, before commencing a new working cycle of a different colour, is extremely simple because it is sufficient to put a certain quantity of solvent inside a clean container and let the machine spin for a while so that the same elements determining a perfect dispersion, grinding and mixing of the paint components also allow a total and perfect cleaning of the machine thus eliminating another of those problems which strike machines of this kind.

All that has been hereto described and illustrated may be subject to modifications suggested by its technical and practical implementation, without going beyond the characteristics of the invention established in the following claims.

I claim:

1. A machine apt for the dispersion, grinding and mixing of more than one substance at the same time for the purpose of obtaining a homogenous mixture of a fixed grain, such as for example, paint, chemical products in general or the like, comprising a cylinder 2 with perforated metal walls for insertion and movement within a mixture held within a container, said cylinder 2 including a top side 3 including means for housing a bottom part of a drive shaft 4 and fastening said drive shaft 4 thereto, so that movement communicated to said drive shaft 4 by at least one engine 5 may be conveyed to said cylinder 2, said cylinder 2 including therein a mixing element 7 integral with a shaft 8 co-axial to shaft 4 but which does not move; a bottom part of shaft 8 being hollow for the purposes of housing a pivot 9 present on a bottom part 6 of cylinder 2 which is free to spin without involving the mixing element 7 in its movement.

2. A machine according to claim 1 containing within said cylinder 2 numerous spheres which are set into motion both by the rotation of said cylinder 2 and by contact with said mixing element 7, said spheres contributing to the dispersion, grinding and mixing of the components of the mixture when the cylinder 2 is lowered into a container 1, into which the components of the mixture have already been added, the movement of said cylinder 2 within the container favouring the recycling of the mixture inside said cylinder 2 itself.

3. A machine according to claim 1 including a second engine 10 communicating a rotary movement to a mixing element 7 positioned within said cylinder 2 for varying the relative speed between said cylinder 2 and mixing element 7 according to working needs, the movement of said mixing element 7 being both in the same direction and in the opposite direction of that of said cylinder 2.

4. A machine apt for the dispersion, grinding and mixing of more than one substance at the same time for the purpose of obtaining a homogenous mixture of a fixed grain, such as, for example, paint, chemical products in general or the like, comprising a container 2 with perforated walls for insertion and movement within a mixture held within a receptacle, said container 2 having a top side 3 including means for housing a bottom part of a drive shaft 4 and fastening said drive shaft 4 thereto, so that movement communicated to said drive shaft 4 by at least one engine 5 may be conveyed to said container 2, said container further including a mixer 7 therein which is integrally connected to a shaft 8 that is coaxial to said shaft 4, said mixer 7 being at least one of stationary with respect to said container 2 and capable of movement independently of said container 2, a lower end of said shaft 8 being hollow so as to hold a pin 9 of a lower part 6 of said container 2, said container 2 being free to rotate independently with respect to said mixer 7.

* * * * *